US009738357B2

(12) United States Patent
Hansen

(10) Patent No.: US 9,738,357 B2
(45) Date of Patent: Aug. 22, 2017

(54) AIR AND FOAM COLLAR FOR WATERCRAFT

(71) Applicant: William M. Hansen, Port Orchard, WA (US)

(72) Inventor: William M. Hansen, Port Orchard, WA (US)

( * ) Notice: Subject to any disclaimer, the term of this patent is extended or adjusted under 35 U.S.C. 154(b) by 0 days.

(21) Appl. No.: 15/356,145

(22) Filed: Nov. 18, 2016

(65) Prior Publication Data

US 2017/0137095 A1 May 18, 2017

Related U.S. Application Data

(60) Provisional application No. 62/257,188, filed on Nov. 18, 2015.

(51) Int. Cl.
*B63B 39/00* (2006.01)
*B63B 43/14* (2006.01)

(52) U.S. Cl.
CPC ..... *B63B 43/14* (2013.01); *B63B 39/00* (2013.01); *B63B 2207/00* (2013.01); *B63B 2731/00* (2013.01)

(58) Field of Classification Search
CPC ..... B63B 2059/025; B63B 7/082
See application file for complete search history.

(56) References Cited

U.S. PATENT DOCUMENTS 6,810,827 B2 * 11/2004 Hansen ..... B63B 7/082 114/345
7,143,714 B1 * 12/2006 Schmidt ..... B63B 59/02 114/345
7,201,865 B2 * 4/2007 Hansen ..... B29C 44/14 264/314

* cited by examiner

*Primary Examiner* — Edwin Swinehart
(74) *Attorney, Agent, or Firm* — Christensen O'Connor Johnson Kindness PLLC

(57) ABSTRACT

A collar assembly for a watercraft includes an elongate tubular casing with a lengthwise sealable opening. A foam core is removably positioned in the tubular casing, and includes a body portion and a plurality of circumferentially spaced foam springs that extend outwardly to engage the tubular casing, to bias the foam core towards a center position in the tubular casing. In some embodiments a body portion of the foam core has a circular cross section, and the foam springs are co-formed with the body portion. In some embodiments the foam core comprises a plurality of longitudinal sections that are enclosed in a membrane having an inflation valve that extends through the tubular casing.

20 Claims, 7 Drawing Sheets

AIR AND FOAM COLLAR FOR WATERCRAFT

CROSS-REFERENCE TO RELATED APPLICATION

This application claims the benefit of Provisional Application No. 62/257,188, filed Nov. 18, 2015; the entire disclosure of said application is hereby incorporated by reference.

BACKGROUND

Modern, high performance watercraft frequently include buoyant outboard collar assemblies or stabilizers that mount onto the watercraft side sheets. The stabilizers provide safety and performance advantages. The stabilizers are configured to remain above the waterline during high-speed straight-line runs, and to engage the water during high-speed turns to limit the amount of heeling in the turn. The stabilizers also provide emergency flotation during unexpected events, for example, to counter rogue waves or to overcome other events that could threaten to swamp the watercraft. Exemplary high performance watercraft are disclosed, for example, in U.S. Pat. No. 5,870,965, to Hansen, which is hereby incorporated by reference in its entirety.

Rigid hull inflatable boats (RHIB) are lightweight but high-performance watercraft, typically constructed with a rigid hull and flexible, inflatable tubes at the gunwale. The inflatable tubes or collar maintain buoyancy of the watercraft, even if a large volume of water shipped aboard. RHIBs are frequently used for workboats, military watercraft, and lifeboats, for example. An exemplary RHIB is disclosed in U.S. Pat. No. 6,223,677, to Hall et al., which is hereby incorporated by reference. An exemplary RHIB with a foam insert is disclosed in U.S. Pat. No. 6,105,532, to Eilert, which is hereby incorporated by reference in its entirety.

An additional advantage of inflatable (air-filled) stabilizers and collars for watercraft are that they are more comfortable and safer for sitting on, and the like, due to their inherent resiliency or compliance, and they are less likely to be damaged from low-speed bumps and collisions. However, if an inflatable stabilizer or collar is punctured, or otherwise loses its inflation, the safety benefits are lost as the watercraft will lose significant buoyancy. Loss of inflation of the stabilizer may subject the watercraft to sinking or capsizing. Another advantage to inflatable stabilizers is that they can usually be easily deflated, for example, to reduce the width of the watercraft to facilitate transporting the watercraft over highways, or the like, and can be re-inflated for use. However, it can be time consuming to fully inflate the stabilizer.

An advantage of foam core stabilizers and collars is that they are not subject to leakage, so the risk of losing buoyancy is avoided. However, foam core stabilizers are less comfortable to sit on, and do not have the same flexibility as inflatable collars in the event the collar impacts another object. Impacts to foam core stabilizers, including repetitive low-speed impacts, can damage the foam core, requiring expensive repair. The foam core of the stabilizer may also shrink over time due to forces applied to the foam core, for example, compression of the foam core by the bladder that encloses the foam core. Over time the foam core becomes "loose" in the bladder, causing the stabilizer to lose some of its buoyancy, and reducing the aesthetic appearance of the watercraft. Also, in conventional foam core stabilizers, the stabilizer cannot be deflated to reduce the width of the watercraft. Therefore, typically the foam core stabilizer must be completely removed if it is necessary to reduce the overall width of the watercraft (i.e., for transporting the watercraft).

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

An inflatable flotation assembly for a watercraft, for example, an RHIB or a watercraft with full side sheets, includes an elongate tubular casing having a sealable opening, and a foam core assembly inserted into the casing that includes a foam body portion and at least three foam springs spaced around the body portion and extending outwardly to bias against the interior of the tubular casing, to center the foam body portion towards a centered position in the casing.

In an embodiment the foam springs are attached to the body portion, for example, with an adhesive or by heat welding.

In an embodiment the foam springs are co-formed with the body portion, for example, the body portion and foam springs may be cut as a unit from a single block of foam.

In an embodiment the foam spring are elongate arcuate members that form a natural hinge with the body portion.

In an embodiment the tubular casing sealable opening extends along a spiral path partially around the tubular casing.

In an embodiment the foam body portion has a circular cross section, and is formed from an expanded polyethylene foam (EPE).

In an embodiment the foam core is enclosed in an inner membrane that includes a valve that extends through a corresponding aperture in the casing, for inflating and pressurizing the inner membrane.

In an embodiment the foam core is formed with a plurality of foam core longitudinal sections, and each of the longitudinal sections is enclosed in separate inner membranes, and each of the membranes has a inflation valve that extends through apertures in the casing.

In an embodiment the tubular casing is configured to be mounted onto a rigid hull.

A rigid hull inflatable boat (RHIB) includes a hull, a tubular casing configured to be mounted to the hull, and a foam core inserted into the tubular casing through the sealable opening. The foam core is formed as a plurality of foam core segments disposed in the tubular casing, wherein each of the foam core segments includes a foam member having a body portion and a plurality of elongate foam springs extending outwardly from the body portion to bias against the tubular casing. Corresponding sealable membranes, each with an inflation valve, enclose each of the foam members.

In an embodiment, each of the plurality of foam springs includes at least four foam springs.

In an embodiment the foam springs are adhesively attached or heat-welded to the body portion of the foam core segments.

In an embodiment the foam body portion and springs are cut as a unitary member from a block of foam.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
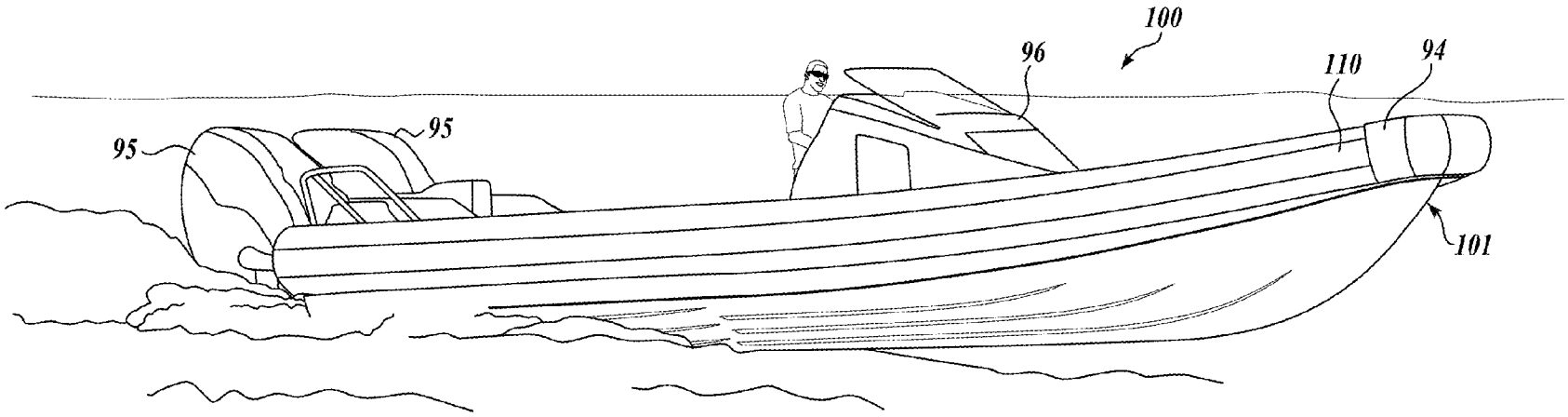
FIG. 1 is an environmental view of a twin outboard engine watercraft having an outboard collar assembly in accordance with the present invention.

An environmental view of a high-performance watercraft 100 in accordance with the present invention is shown in FIG. 1. The watercraft 100 includes a rigid hull 101 having a stabilizing member or collar assembly 110 with oppositely disposed port and starboard elongate portions (starboard portion visible). In this embodiment, the outboard collar assembly 110 includes one or more buoyant inserts, for example, polymeric foam inserts, that are enclosed inside a rugged outer membrane or flexible casing, as discussed below. The outboard collar assembly 110 extends longitudinally along all or most of the length of the rigid hull 101 on either side. In some embodiments the collar assembly 110 is securely mounted to hull side sheets that extend upwardly from the hull 101. For example, the collar assembly 110 may attach with a quick connect system. An exemplary mounting system is disclosed in U.S. Patent Application Publication No. 2015/0375838 A1, to Hansen, which is hereby incorporated by reference in its entirety. The hull 101 in a current embodiment is formed primarily from aluminum and may be, for example, 12 feet to 80 feet in length. Other hull sizes and materials are also contemplated.

The collar assembly 110 in some embodiments is mounted on an upper portion of the side sheets such that the collar assembly 110 does not engage the water when the watercraft 100 is travelling along a straight path. If the watercraft 100 heels sufficiently, for example, during high-speed turns, or the like, or due to weather and/or water conditions, the collar assembly 110 engages the water on the heel side, thereby providing additional buoyancy countering the heeling forces. If the watercraft 100 takes on sufficient water, for example, if the hull is compromised or if the watercraft 100 is otherwise heavily loaded, the collar assembly 110 provides additional buoyancy to prevent the watercraft from sinking. The collar assembly 110 is sized to prevent the watercraft 100 from sinking even in worse-case conditions, including capsizing or the like.

In other embodiments the watercraft 100 is a rigid hull inflatable boat (RHIB), and does not have side sheets. An exemplary tube attachment device for attaching a tube to a hull is disclosed in U.S. Pat. No. 5,584,260, to Hemphill, which is hereby incorporated by reference in its entirety.

In the watercraft 100 shown in FIG. 1 an optional center console 96 is disposed approximately mid-ship, and one or more outboard motors 95 (two shown) provide propulsion. It will be readily apparent to persons of skill in the art that other lengths, construction materials, number and type of motors, and the like, may be used without departing from the present invention. In this embodiment, the collar assembly 110 comprises two separable portions, and a forward end of each stabilizer portion is configured to engage a receiver 94 (referred to as a bow wrap) that is securely fixed to the bow of the watercraft 100. In other embodiments the collar assembly 110 is formed as a single U-shaped assembly, and is configured to extend along the upper perimeter of the port side, the bow, and the starboard side of the hull 101.

Figure 2:
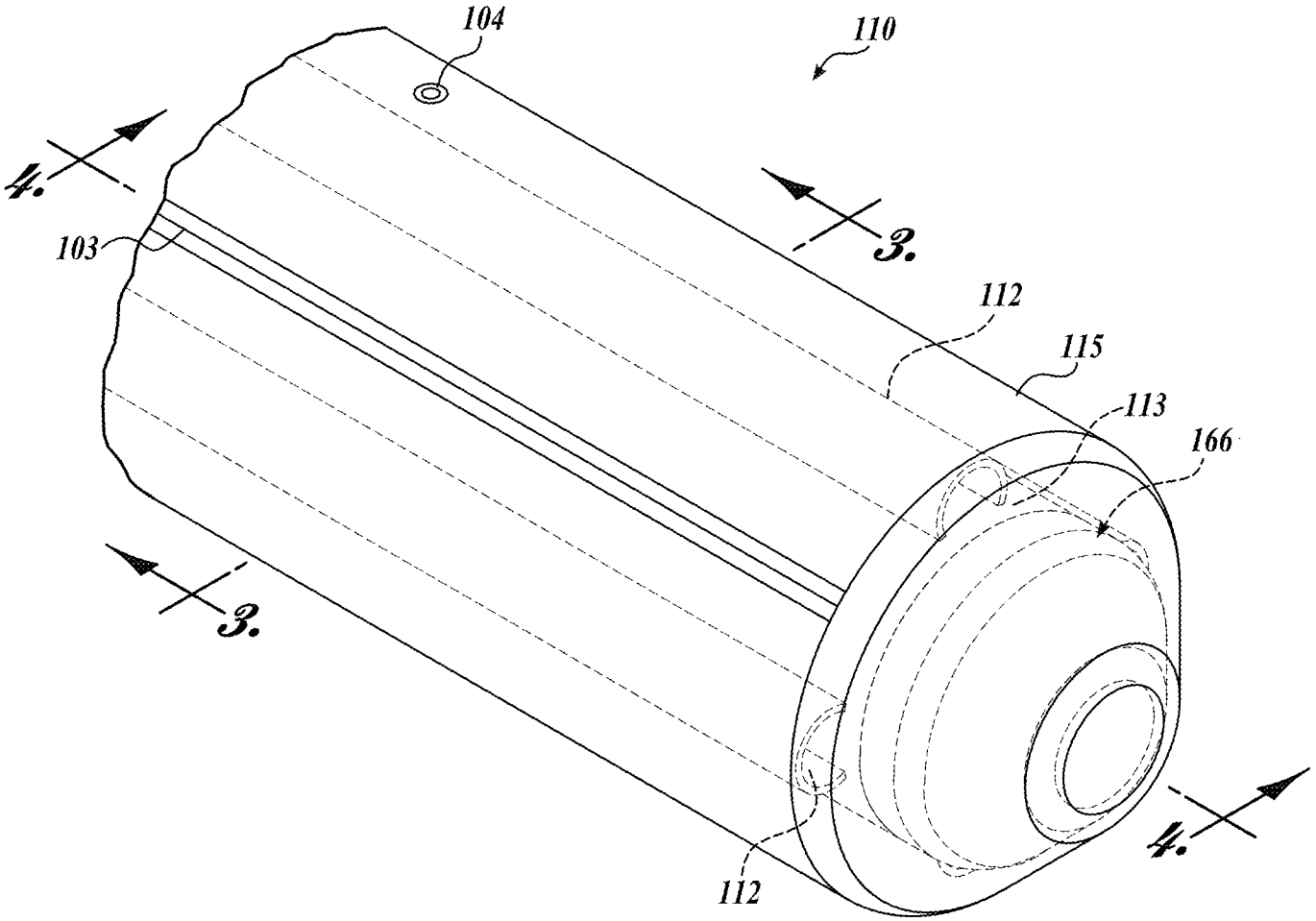
FIG. 2 is a fragmentary perspective view of an aft end of the collar assembly shown in FIG. 1, with the interior core assembly shown in phantom.

FIG. 2 is a perspective view of an aft end of one side of the collar assembly 110, shown in isolation. A transverse cross-sectional view of the collar assembly 110 through section 3-3 is shown in FIG. 3, and a longitudinal cross-sectional view of the end portion of the collar assembly 110 through section 4-4 is shown in FIG. 4.

The collar assembly 110 includes an external bladder or casing 115, and a foam core 111 that is approximately centered in the casing 115. The foam core 111 includes a central body portion 113 and a plurality of elongate peripheral foam springs 112. The foam springs 112 are configured to center the foam core 111 in the external casing 115.

The external casing 115 includes a sealable and recloseable opening 103 to facilitate inserting and removing the foam core 111. The casing 115 further includes a valve or opening 104 to facilitate inflating the casing 115 to a desired pressure. Although in this embodiment the casing 115 is inflated and pressurized, in other embodiments, for example, the embodiment shown in FIGS. 6 and 7, the collar assembly is not directly inflated or relied on to maintain a positive pressure in the tube assembly.

Figure 3:
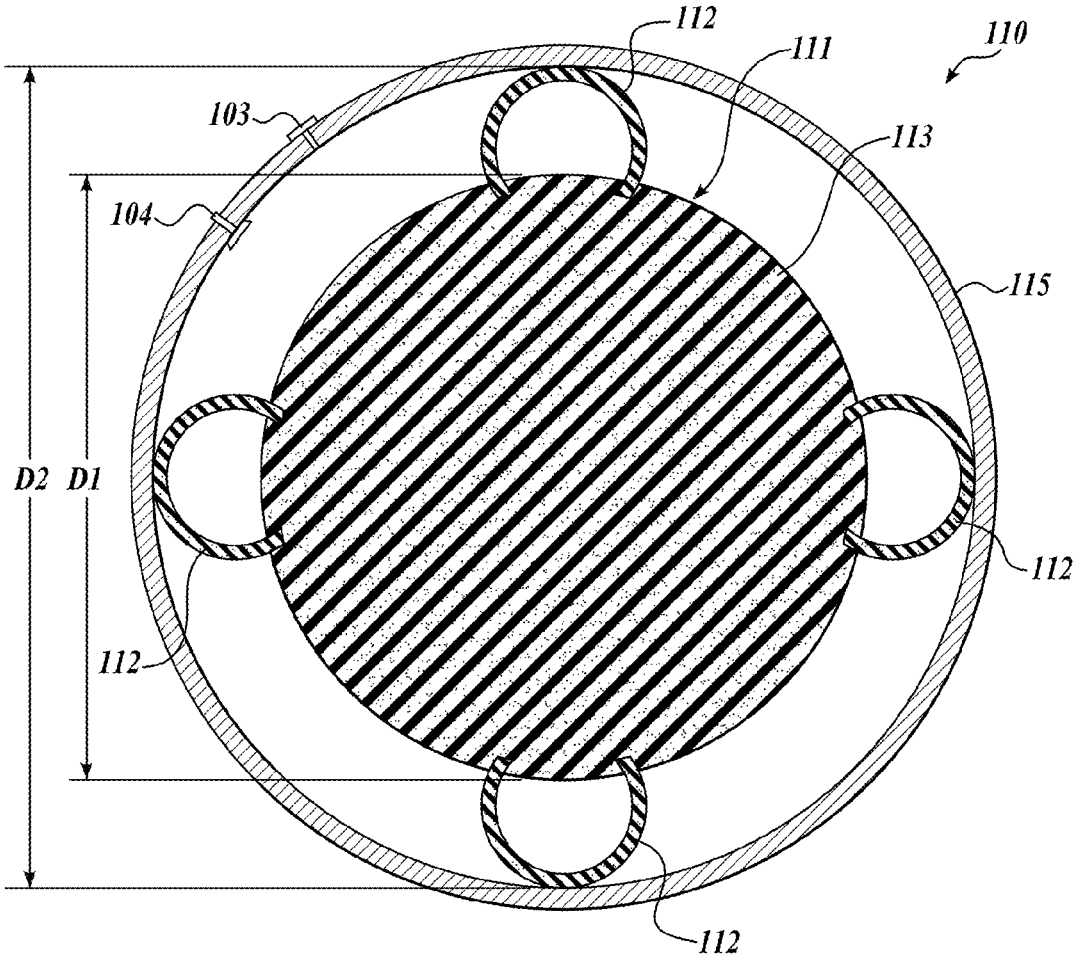
FIG. 3 is a transverse sectional view of the collar assembly through section 3-3 indicated in FIG. 2.
Figure 4:
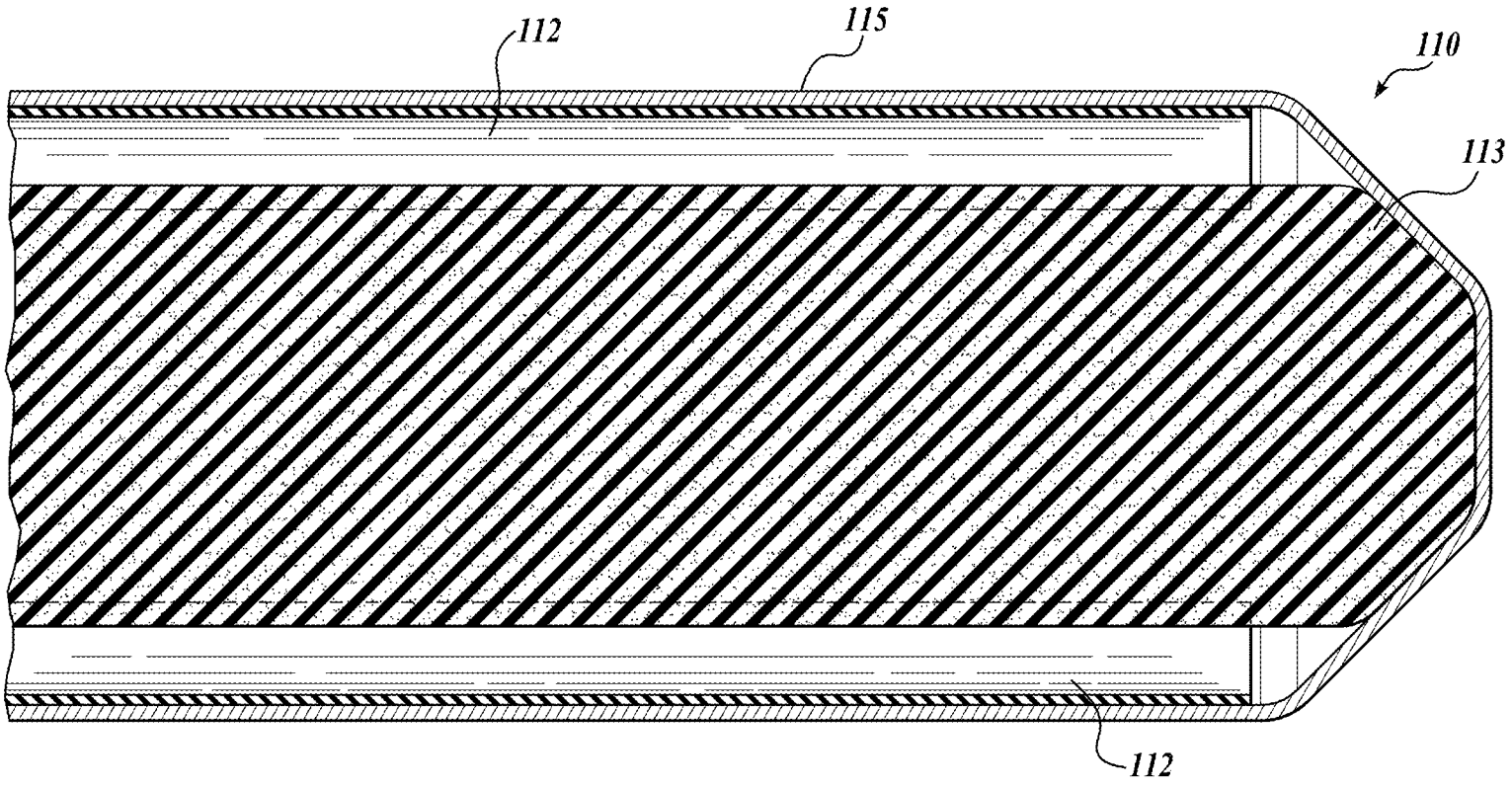
FIG. 4 is a longitudinal sectional view of the collar assembly through section 4-4 indicated in FIG. 2.

Referring now to FIG. 3, the body portion 113 of the foam core 111 has a diameter D1 that is smaller than the inside diameter D2 of the external casing 115. For example, in some embodiments D1 is between 0.80*D2 and 0.95*D2, such that the foam core 111 has a volume between about 65% of the enclosed volume of the casing 115 and 90% of the enclosed volume of the casing 115, respectively.

In some embodiments the foam core 111 does not have a circular cross section. For example, the foam core 111 in some embodiments has a polygonal cross section. In other embodiments the foam core 111 has an elliptical or otherwise curved, cross section. In some embodiments the cross-sectional shape and/or transverse dimension D1 of the foam core 111 varies along the length of the foam core. In embodiments wherein the body portion of the foam core is not circular, and/or the interior of the casing has a non-circular cross section, the body portion of the foam core has a volume that is between 65% and 90% of the enclosed volume of the casing.

In a currently preferred embodiment about 80% of the enclosed volume of the casing 115 is taken by the body portion 113 of the foam core 111.

The collar assembly 110 includes a plurality of elongate foam springs 112 that are fixed to the body portion 113. In the embodiment shown in FIGS. 2-4 four elongate foam springs 112 are fixed to an outer surface of the body portion 113. The foam springs 112 are spaced around the body portion 113, and are sized to bias against the external casing 115 in the assembled assembly 110, thereby urging the foam core 111 towards a centered position within the casing 115. In this embodiment four foam springs 112 extend along substantially the length of the body portion 113, and are evenly spaced around the body portion 113, for example, between 80% and 100% of the length of the body portion 113. Three foam springs 112 or more than four foam springs 112 may alternatively be used, and may be preferable in some applications, for example, for larger collar assemblies 110.

It will now be appreciated that the plural elongate foam springs 112 extending along most of the length of the body portion 113 provide a large spring action surface. Therefore, the foam springs 112 do not have to provide a large local spring force to keep the foam core 111 centered in the casing 115. Importantly, it has been found that the elongate foam springs 112 do not produce a noticeably stiffer region along the length of the collar assembly 100. Therefore, the foam springs 112 do not interfere with users comfort when sitting on or straddling the collar assembly 110, and do not result in noticeably increased wear on the exterior surface of the casing 115 over time.

Figure 5:
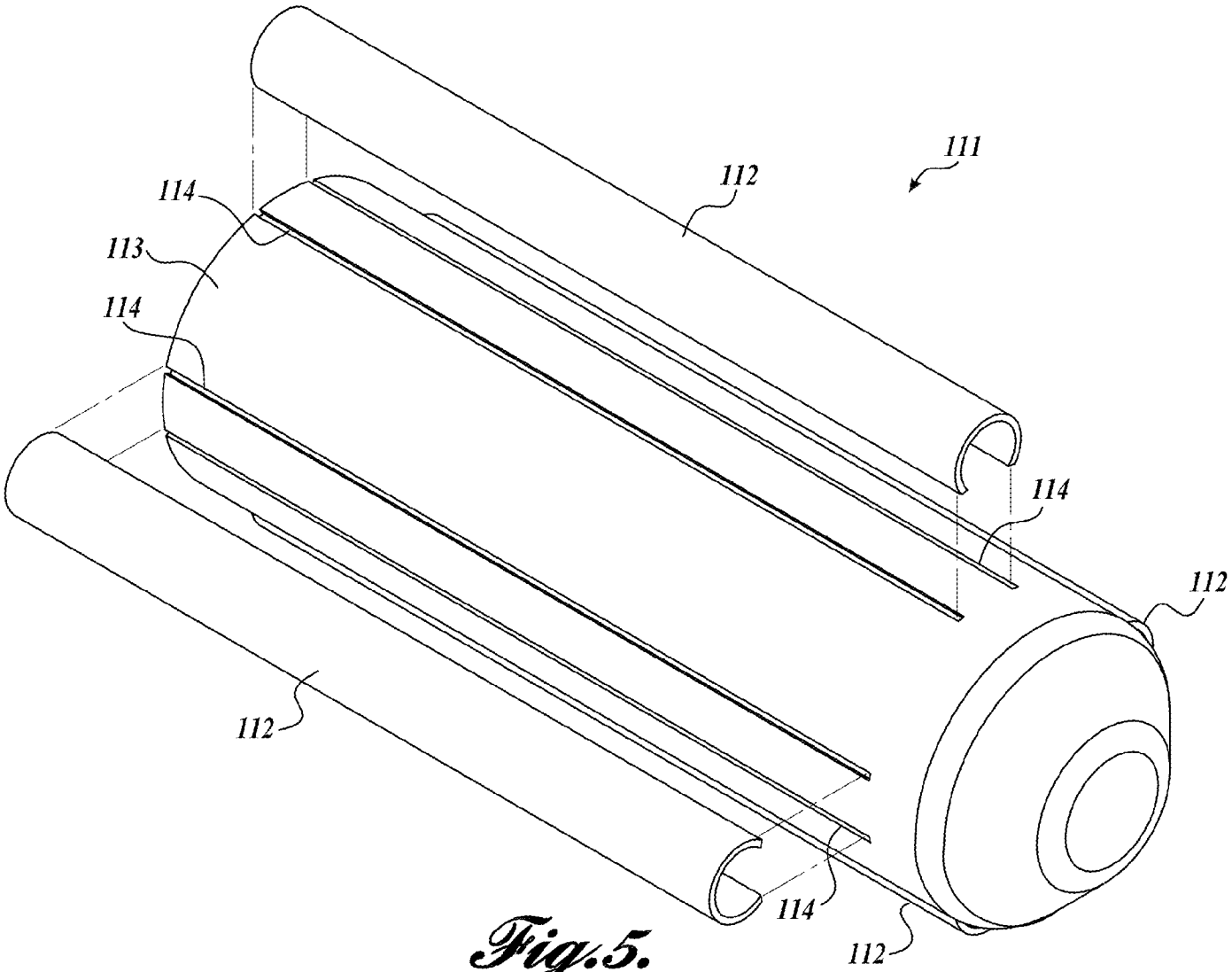
FIG. 5 is a partially exploded view of the foam core for the collar assembly shown in FIG. 2.

As illustrated in the fragmentary exploded view in FIG. 5, the body portion 113 may optionally include a plurality of channels 114 that are configured to corresponding receive edges of the foam springs 112. For example, the foam springs 112 may be adhesively or thermally fixed to the body portion 113.

The foam springs 112 in this embodiment are arcuate and generally semi-circular or horseshoe shaped. It is contemplated that the cross-sectional shape of the foam springs 112 may alternatively have other shapes, for example, the foam springs may be semi-oval or elliptical in cross section, or diamond or polygonal in cross section. An optimal cross-sectional shape of the foam springs 112 may depend on the size of the foam core 111 relative to the volume enclosed by the casing 115.

In a current embodiment the foam core 111 is an expanded polyethylene (EPE) providing over 60 pounds of flotation per cubic foot. EPE is extremely lightweight, absorbs virtually no water, is resistant to chemical exposure such as fuels, and has excellent shape memory properties. Another class of foam suitable for the foam core is polypropylene, which also has excellent fuel-resistant properties. Although the foam springs 112 and the body portion 113 are formed from the same material in the current embodiment, it is contemplated that the foam springs 112 and the body portion 113 may be formed from different polymeric foams.

It will be appreciated that the foam springs 112 cooperate to center the foam core 111 in the casing 115, with the body portion 113 positioned away from the inner surface of the casing 115. The body portion 113 is therefore protected from bumps, and from rubbing or otherwise wearing against the casing 115 during use. The foam springs 112 are sized such that the maximum transverse dimension of the assembled foam core 111 and foam springs 112 is at least equal to the inside diameter D2 of the casing 115. Preferably, the maximum transverse dimension of the assembled foam core 111 and foam springs 112 is greater than the inside diameter D2, such that the foam springs 112 are partially compressed when the collar 100 is assembled.

Although the current embodiment includes four foam springs 112, it is contemplated that more or fewer springs may be used. For example, it may be advantageous to have only three foam springs 112, equally spaced around the foam core 111, to reduce the cost of manufacture. It may be advantageous in some embodiments to have six or more spaced apart foam springs 112, particularly for larger diameter collar assemblies 110. In some embodiments configured for watercraft having side sheets, the foam core 111 may have a flat side that is configured to abut the side sheet (e.g., with the casing 115 located between the foam core 111 and the side sheet. In these embodiments, a foam core in accordance with the present disclosure is centered in the casing 115 in the vertical direction only, i.e., in the direction parallel to the associated side sheet.

The stabilizer or collar 100 combines the comfort, pliability, and impact resistance benefits of an inflatable tube with the unsinkability of a foam core stabilizer. The collar 100 defines a substantially air-filled annular channel adjacent the external casing 115 and a foam core 111 that is spaced away from the casing 115. The foam core 111 will continue to provide significant buoyancy even if the casing 115 is severely ruptured.

The foam core 111 is held away from the inner surface of the casing 115, but is prevented from engaging and abrading the casing 115 by the foam springs 112. During normal use, a user sitting on the collar 100, for example, will experience the comfort of an inflatable member, and if the collar 100 bumps up against another object, for example, another watercraft or a dock, any user limb between the collar 100 and the object will benefit from the compliance of the inflated casing. However, in the event of damage to the casing 115, the collar 100 will still provide desired buoyancy even if the casing becomes completely deflated. In addition, if the watercraft is trailered, the air can be removed from the casing 115 to reduce the width of the watercraft.

Figure 6:
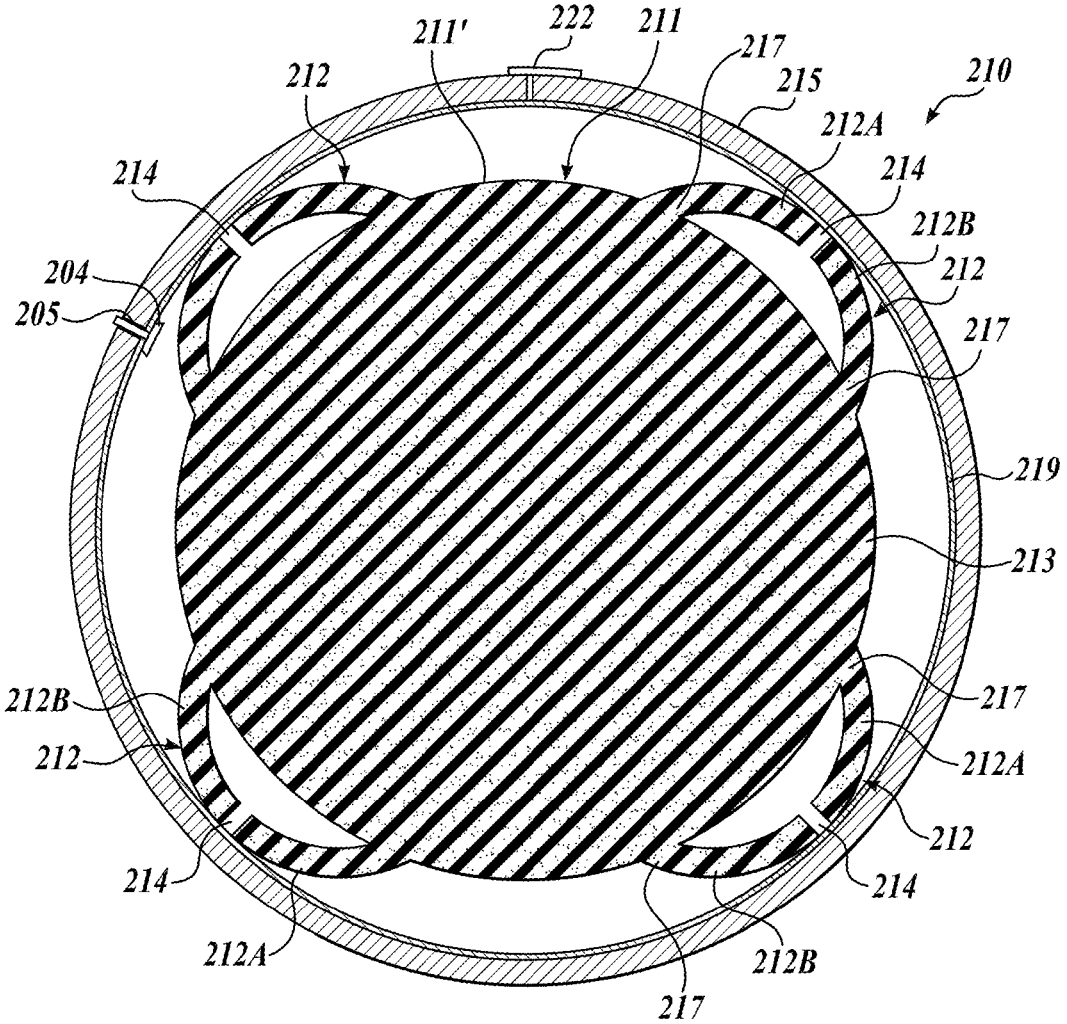
FIG. 6 is a transverse sectional view of another embodiment of a collar assembly for a watercraft in accordance with the present invention.

Another embodiment of a collar assembly 210 in accordance with the present invention is shown in cross section in FIG. 6. The collar assembly 210 is similar to the collar assembly 110 discussed above, except as discussed and described herein. The collar assembly 210 includes a foam core 211 that may be formed in a plurality of longitudinal core sections or segments 211', as shown more clearly in FIG. 7. For example, in some embodiments the collar assembly 210 may include between four and ten foam core sections 211'.

The foam core section 211' includes a body portion 213 that may be substantially circular in cross section and a plurality of integral foam spring members 212 that are co-formed with the body portion 213. For example, in a current embodiment an elongate cutting blade (not shown) is used to cut the foam core sections 211' as a single unit from a foam block.

In this embodiment the foam core sections 211' include four spaced-apart spring members 212, although more or fewer springs 212 are contemplated. The spring members 212 each include paired arcuate portions 212A, 212B that extend along the length of the section 211'. In a current embodiment the distal ends of the paired arcuate portions 212A, 212B define a gap 214 between the arcuate portions. The proximal ends of the arcuate portions 212A, 212B, which are co-formed with the body portion 213, form a natural spring 217. As the foam springs 212 are compressed, a relatively small spring constant will initially be encountered due to the natural springs 217.

Figure 7:
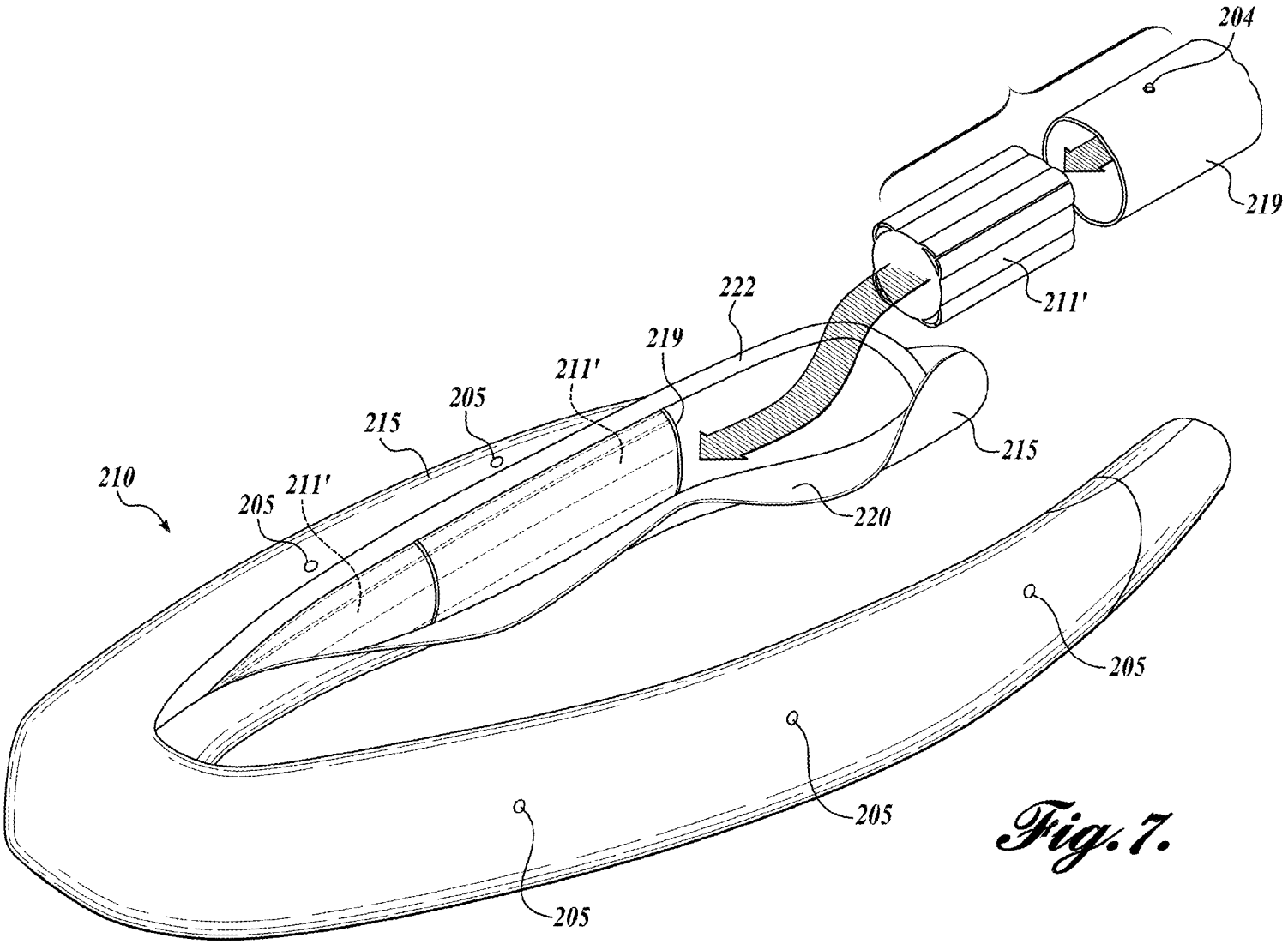
FIG. 7 illustrates assembly of the collar assembly shown in FIG. 6, wherein the core portion is formed as a plurality of separate sections.

Refer also to FIG. 7, which illustrates a foam core section 211' being inserted into the casing 215, with two foam core sections 211' already inserted into the casing 215. In this embodiment the foam core sections 211' are each enclosed within separate inner membranes 219, prior to insertion into the collar assembly 210 casing 215.

The casing 215 includes an elongate closure 220 that allows for easy insertion and removal of the foam core sections 211'. A flap 222 extends along one edge of the opening 221, and a closure mechanism, for example, a hook and loop fastener, a zipper, or the like (not shown), releasably closes the opening 221. Preferably the closure 220 is oriented to spiral or curve partially around the circumference of the casing 215 as it extends longitudinally along the casing 215, which has been found to cause the flap portion 222 of the closure to remain flat against the collar assembly 210. For example, the opening may extend circumferentially between 25% and 75% of the circumference of the casing 215. The spiral orientation of the opening 221 has been found to maintain the flap 222 flat against the casing 215 when the assembly is closed, and to prevent undesirable buckling in the closure portion 220 during use.

The inner membranes 219 for each of the foam core sections 211' are sealed, and include a valve or closeable opening 204 that is configured to extend through a corresponding aperture 205 in the casing 215. In some embodiments all of the foam sections 211' on one side of the watercraft are enclosed in a single inner membrane 219.

The inner membranes 219 are pressurized, rather than pressurizing the external casing directly, and the pressurized membranes 219 press outwardly against the external casing. This construction provides several benefits. It is contemplated that the inner membranes 219 may be constructed from a relatively thin and lower-cost material than the outer casing 215, because the inner membranes are not exposed, and therefore do not need to withstand external wear and other forces that may arise from normal boating activities. In addition, upon inflation the inner membranes 219 press against the outer casing 215, and therefore do not need to withstand the air pressure. If an inner membrane 219 becomes punctured it will be relatively easy and inexpensive to replace or repair a single foam core section 211' of the foam core 211, than to repair the external casing 215. In a current embodiment of the collar assembly 210 the inner membranes 219 are inflated to the design pressure (e.g., 1 to 9 psi) after they are inserted into, and supported by, the external casing 215. Although the inner membrane 219 is inflated to a design pressure, the membrane is supported externally by the external casing 215. Therefore, the external casing 215 supports the pressurized inner membranes 219, which may therefore be fabricated from a lighter, less-expensive material. If the external casing 215 develops a leak or small puncture, it does not need to be repaired to maintain inflation. Any repair of the casing 215 does not need to be an air-tight repair because the inner membranes 219 provide the air-tight seal.

The collar assembly 210 also may provide advantages for transporting the watercraft 100, by allowing the user to reduce the width of the watercraft. When the watercraft is to be transported the inner membranes 219 may be deflated, and the closure portion 220 can be opened to remove the foam core sections 211', and stored, for example, in an interior portion of the watercraft. The external casing 215 may then be pulled inboard and strapped or otherwise secured for transportation. When the watercraft 100 is to be deployed, the user prepares the external casing 215, inserts the core sections 211', seals the closure portion 220, and inflates the inner membranes 219 to the design pressure.

While illustrative embodiments have been illustrated and described, it will be appreciated that various changes can be made therein without departing from the spirit and scope of the invention.

The invention claimed is:

1. An inflatable flotation assembly for a watercraft comprising:

an elongate tubular casing having a sealable opening extending along a length of the tubular casing;

a foam core configured to be inserted into the tubular casing through the sealable opening, the foam core comprising:

a body portion having an outer surface; and at least three circumferentially spaced apart foam springs extending outwardly from the outer surface of the body portion, wherein the foam springs are sized and configured to bias against an interior surface of the tubular casing such that the at least three foam springs bias the body portion toward a centered position in the tubular casing.

2. The inflatable flotation assembly of claim 1, wherein the at least three foam springs are fixedly attached to the body portion by welding or with an adhesive.

3. The inflatable flotation assembly of claim 1, wherein the body portion and the at least three foam springs are co-formed as a single unitary structure.

4. The inflatable flotation assembly of claim 3, wherein the body portion and the at least three foam springs are cut as a single unit from a block of foam.

5. The inflatable flotation assembly of claim 3, wherein each of the at least three foam springs comprises a pair of opposed elongate spring portions that are arcuate in the transverse direction, wherein a radially inner end of the opposed elongate spring portions form a natural hinge with the body portion.

6. The inflatable flotation assembly of claim 1, wherein the sealable opening of the tubular casing extends along a spiral path around a portion of the tubular casing.

7. The inflatable flotation assembly of claim 1, wherein the body portion of the foam core has a circular cross section.

8. The inflatable flotation assembly of claim 1, wherein the body portion of the foam core is formed from an expanded polyethylene foam.

9. The inflatable flotation assembly of claim 1, further comprising an inner membrane configured to enclose the foam core, wherein the inner enclosure includes an inflation valve configured to extend through a corresponding aperture in the tubular casing.

10. The inflatable flotation assembly of claim 1, wherein the foam core comprises a plurality of foam core longitudinal sections, and wherein each of the plurality of longitudinal sections are enclosed in a corresponding one of a plurality of an inner membranes.

11. The inflatable flotation assembly of claim 10, wherein the plurality of inner membranes each comprises a valve configured for inflating the corresponding inner membrane.

12. The inflatable flotation assembly of claim 11, wherein the elongate tubular casing further comprises a plurality of apertures, wherein in each aperture is sized and positioned to receive the valve of one of the plurality of inner membranes.

13. The inflatable flotation assembly of claim 1, wherein the elongate tubular casing is configured to be mounted onto a rigid hull.

14. A rigid hull inflatable boat comprising:

a hull;

a tubular casing configured to be mounted to a perimeter of the hull, the tube assembly having a sealable opening extending along a length of the tubular casing; and a foam core inserted into the tubular casing through the sealable opening, the foam core comprising a plurality of foam core segments disposed in the tubular casing, wherein each of the foam core segments comprise a foam member having a body portion and a plurality of elongate foam springs extending outwardly from the body portion to bias against the tubular casing, and a sealable membrane enclosing the foam member, wherein the sealable membrane has an inflation valve.

15. The rigid hull inflatable boat of claim 14, wherein the plurality of foam springs comprise at least four foam springs.

16. The rigid hull inflatable boat of claim 14, wherein for each of the foam core segments the plurality of foam springs are adhesively attached to the body portion.

17. The rigid hull inflatable boat of claim 14, wherein for each of the foam core segments the plurality of foam springs and the body portion are cut as a unitary member from a block foam.

18. The rigid hull inflatable boat of claim 14, wherein the sealable opening of the tubular casing extends along a spiral path around a portion of the tubular casing.

19. The rigid hull inflatable boat of claim 14, wherein the body portion of each foam member has a circular cross section.

20. The rigid hull inflatable boat of claim 14, wherein each of the foam members is formed from an expanded polyethylene foam.

* * * * *